US006311332B1

(12) United States Patent
Lien

(10) Patent No.: US 6,311,332 B1
(45) Date of Patent: Nov. 6, 2001

(54) HAT HAVING A WINDOW WITH REPLACEABLE PATTERNS

(76) Inventor: Jack Lien, No. 30, Yen-Chi St., Kaohsiung City (TW)

( * ) Notice: Subject to any disclaimer, the term of this patent is extended or adjusted under 35 U.S.C. 154(b) by 0 days.

(21) Appl. No.: 09/716,968

(22) Filed: Nov. 22, 2000

(51) Int. Cl.[7] ..... A42B 1/24
(52) U.S. Cl. ..... 2/209.13; 2/175.1; 40/329
(58) Field of Search ..... 2/175.1, 181, 181.2, 2/195.1, 181.6, 209.11, 209.12, 209.14, 209.3, 209.4, 209.7, 209.13, 422; 40/329

(56) References Cited

U.S. PATENT DOCUMENTS 2,796,680 * 6/1957 Wittcoff ..... 2/171
2,803,829 * 8/1957 Tscharner ..... 2/171
4,451,935 * 6/1984 Henschel ..... 2/185
4,484,363 * 11/1984 Varanese ..... 2/209.1
5,452,479 * 9/1995 Mostert ..... 2/195.1
5,465,426 * 11/1995 Beaton ..... 2/195.1
5,548,847 * 8/1996 Spicijaric ..... 2/209.13
5,581,813 * 12/1996 Henschel ..... 2/195.1
6,154,992 * 12/2000 Lee ..... 40/329

* cited by examiner

*Primary Examiner*—John J. Calvert
*Assistant Examiner*—Katherine Moran
(74) *Attorney, Agent, or Firm*—Birch, Stewart, Kolasch & Birch, LLP

(57) ABSTRACT

A hat with a window at a transparent frame installed at the front edge thereof. By the orientation of the cover frame, the opening and closing of an opening can be controlled by the orientation of the cover frame so that the manufacturer or user may change patterns on the window rapidly, and thus the hat can present various styles.

1 Claim, 3 Drawing Sheets

HAT HAVING A WINDOW WITH REPLACEABLE PATTERNS

BACKGROUND OF THE INVENTION

The present invention relates to a hat with a window, and especially to a hat which can present various styles by changing the patterns or trademarks on the hat.

In general, the manufacturers print patterns or trademarks on hats so that the hat can present a vivid outlook. Conventionally, in the manufacturing process, if it is desired to add patterns to hats, the work is complex and thus cost is increased. Especially, as it is desired to change the patterns of a hat, the conventional way is to renew the printing plate and reprint it. However, much time is required. For the consumers, the hat must be matched with the styles of the clothing, while it often occurs that the patterns or trademarks on the hat are not matched with the style of the clothing, but the patterns or trademarks can not be removed.

However, nowadays, fashion trends are varied quickly and often in election, often the marks are printed on hat for presenting the support to some candidate, but after electing, these hats are not used so that these hats become waste and will pollute the environment. Therefore, there is an eager demand for a novel design of a hat, in which the patterns or trademarks are replaceable by the user. Thereby, the hat is not only a tool for shielding sunlight, but also it becomes a decoration with changeable patterns.

SUMMARY OF THE INVENTION

Accordingly, the primary object of the present invention is to provide a hat having a window made of soft material. A transparent frame is formed at a front end of a cover frame of the hat. The cover frame has a transparent frame. A lower edge of the transparent frame has an opening for being passed through by an imaginary message sheet for presenting a message. As the hat is used, the opening faces downwards and is sealed by an edge of the hat so that the imaginary message sheet is placed into the transparent frame. It is fixed therein and messages thereon can be presented through the transparent frame. If the messages are desired to be updated, then the orientation of the cover frame is changed so that the opening is horizontal to the edge of the hat, and thus, the imaginary message sheet can be placed into the transparent frame rapidly. Therefore, the hat with a window can present the image of the user.

The hat of the present invention has the following advantages:

1. By the transparent frame of the present invention, the manufacturers can change the trademark on the hat rapidly and quickly.
2. The present invention can meet the requirement of environment protection, as the mark on the hat is undesired, such as a mark used in a special period, for example, election, only the imaginary message sheet in the hat is necessary to be deserted, not the whole hat.
3. The hat of the present invention may present the personality of the user. The user can print patterns from a computer and then insert the patterns into the transparent frame of the hat according to the present invention.
4. The present invention can be used as an active advertisement. The advertising content can be present through the transparent frame so as to present a preferred advertising effect.
5. The present invention can be used as an effect of searching for some peoples or record words. These messages can be presented on the head so as to enhance the effect.

BRIEF DESCRIPTION OF FIGURES

Embodiments of the present invention will hereinafter be described, by way of example, with reference to the accompanying drawings, in which.

DESCRIPTION OF PREFERRED EMBODIMENTS

Figure 1:
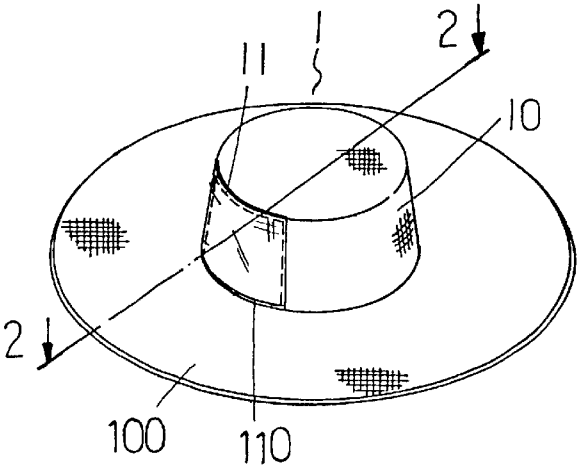
FIG. 1 is a perspective view of the present invention.
Figure 2:
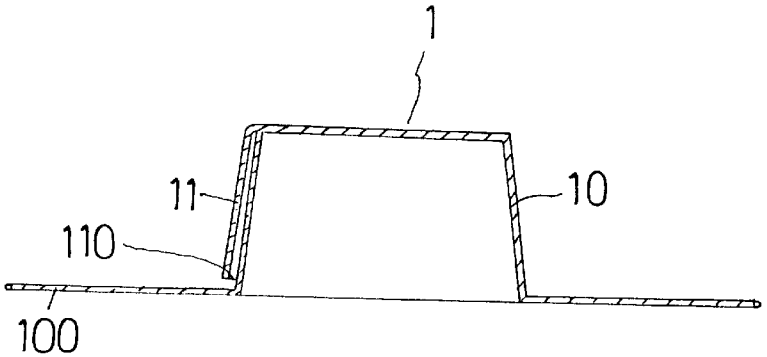
FIG. 2 is a cross sectional view of the present invention.

With reference to FIGS. 1 and 2, in the present invention, the front edge of the cover frame 10 of a hat 1 is formed with a transparent frame 11. The lower edge of the transparent frame 11 has an opening 110 for being passed through by an imaginary message sheet 12 (not shown) for presenting message. The lower edge of the opening 110 faces downwards with respect to the hat rim 100 of the hat.

Figure 4:
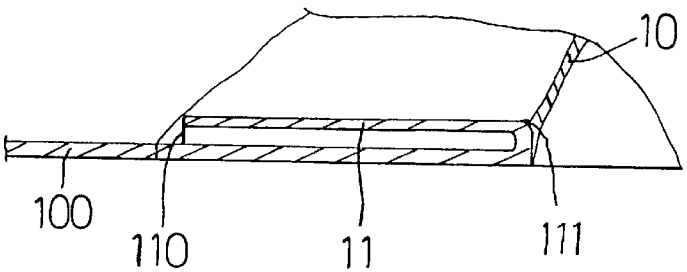
FIG. 4 shows the opening of the window in the present invention.
Figure 3:
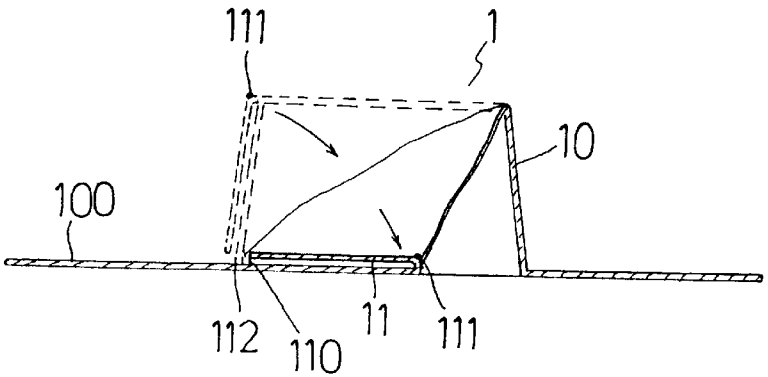
FIG. 3 is a view showing the depressing operation of the present invention.
Figure 6:
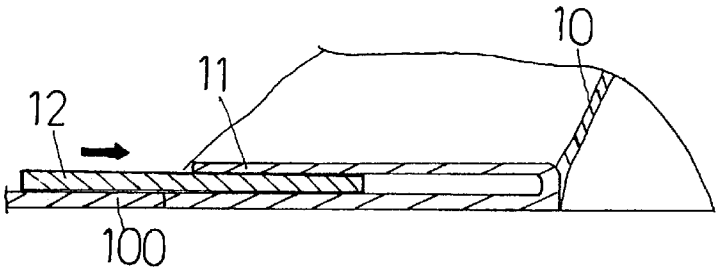
FIG. 6 is an enlarged view of the present invention.
Figure 8:
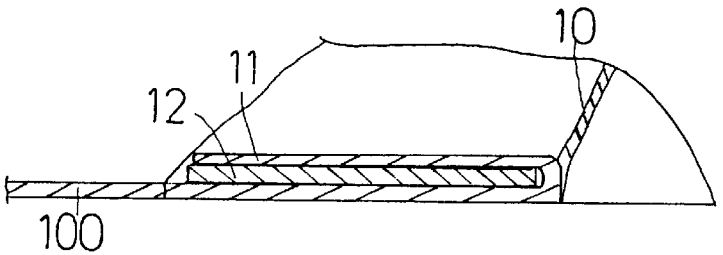
FIG. 8 is an assembled enlarged view of the present invention.
Figure 5:
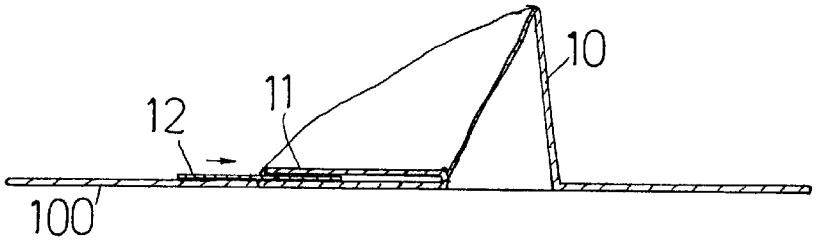
FIG. 5 shows the device of the present invention.
Figure 7:
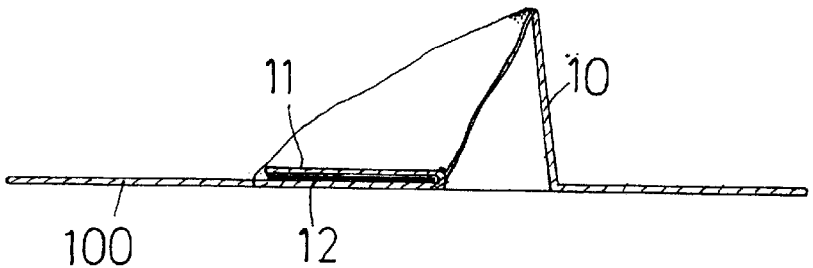
FIG. 7 is an assembled view of the present invention.
Figure 10:
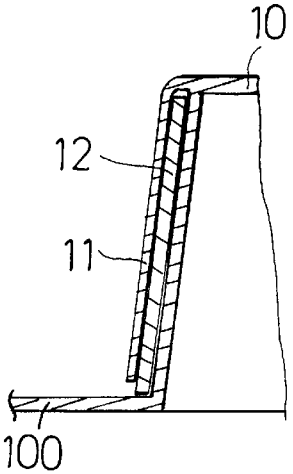
FIG. 10 is an enlarged view showing the opening being closed.
Figure 12:
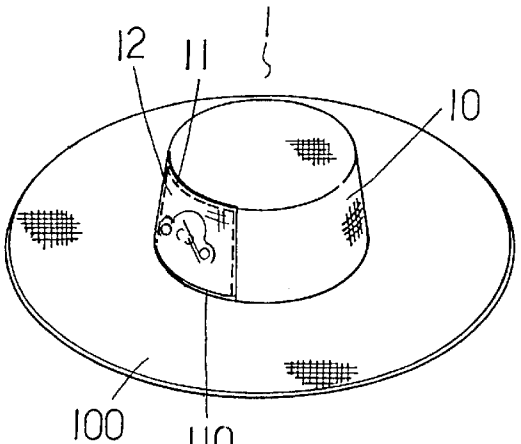
FIG. 12 shows the outlook of the present invention.
Figure 9:
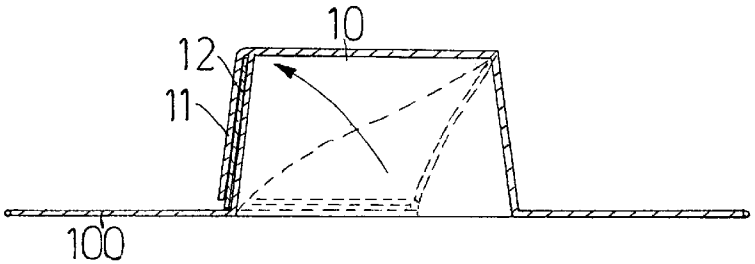
FIG. 9 is a view showing the opening being closed in the present invention.
Figure 11:
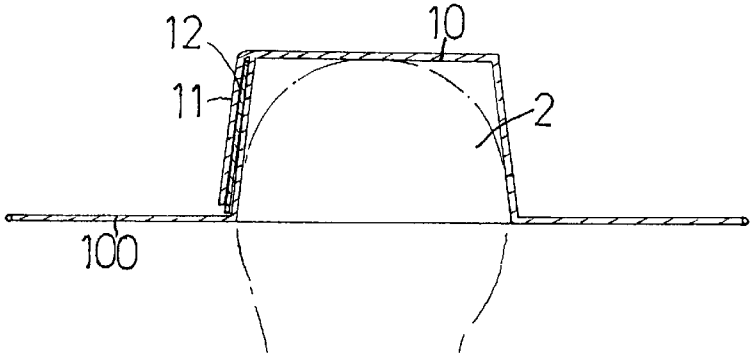
FIG. 11 shows one application of the present invention.

If the required messages or creative patterns are desired to be present on the front edge of the hat, the connection 111 between the upper edge of the transparent frame 11 and the top edge of the cover frame 10 is depressed along the fulcrum of the point 112 (see FIG. 3) so that the opening 110 original vertically opened becomes horizontal. The opening 110 is now opened (see FIG. 4). Then, the imaginary message sheet 12 is placed into the opening 110 (see FIGS. 5 and 6). Thus, the imaginary message sheet 12 is positioned to the transparent frame 11. After the imaginary message sheet 12 is combined thereinto, the cover frame 10 is restored to the original shape so that the opening 110 is vertical to the edge of the hat from the original horizontal orientation (referring to FIGS. 7 and 8). The opening 110 is sealed by the top edge of the hat rim 100. Therefore, the imaginary message sheet 12 is completely combined in the transparent frame 11 and does not fall out. Thus, message can be presented through the transparent frame 11 (referring to FIGS. 9 and 10). A window structure for presenting image is formed. Therefore, the user may change the content of the imaginary message sheet 12 rapidly and easily. After the hat is worn, the message or advertisement can be updated rapidly (referring to FIGS. 11 and 12).

It will also be appreciated that other modifications and variations may be made to the embodiments as described and illustrated within the scope of the present application as defined in the following claims.

We claim:

1. A hat having a window with replaceable patterns and being made of soft material, a transparent frame being formed at a front end of a cover frame of the hat, the cover frame having a transparent frame, a lower edge of the transparent frame having an opening for being passed through by an imaginary message sheet for presenting messages; as the hat being used, the opening facing downwards and being sealed by an edge of the hat so that after an imaginary message sheet is placed into the transparent frame, it is fixed therein and messages thereon can be presented through the transparent frame; if the messages are desired to be updated, the orientation of the cover frame is changed so that the opening is horizontal to the edge of the hat then the imaginary message sheet can be placed into the transparent frame rapidly, therefore, the image of the user can be presented by the hat with a window.

* * * * *